United States Patent [19]

Phillips

[11] 3,981,948

[45] Sept. 21, 1976

[54] ARRANGEMENTS IN SPINNERETS OF SPINNING ORIFICES HAVING SIGNIFICANT KNEEING POTENTIAL

[75] Inventor: Bobby M. Phillips, Kingsport, Tenn.

[73] Assignee: Eastman Kodak Company, Rochester, N.Y.

[22] Filed: Jan. 2, 1975

[21] Appl. No.: 538,066

[52] U.S. Cl. ..... 264/40.7; 156/167; 264/177 F; 264/209; 428/398

[51] Int. Cl.[2] ..... B28B 21/54

[58] Field of Search ..... 264/176 F, 177 F, 209; 425/382, 464, 461; 428/397, 398; 156/167

[56] References Cited

UNITED STATES PATENTS

| | | | |
|---|---|---|---|
| 3,405,424 | 10/1968 | Imobersteg et al. | 264/177 F |
| 3,528,128 | 9/1970 | Murakami et al. | 264/177 F |
| 3,558,420 | 1/1971 | Opfell | 264/177 F |
| 3,623,939 | 11/1971 | Ono et al. | 264/177 F |
| 3,640,670 | 2/1972 | Palieyenko et al. | 264/177 F |
| 3,650,659 | 3/1972 | Stapp | 264/177 F |
| 3,728,428 | 4/1973 | Turner | 264/177 F |
| 3,772,137 | 11/1973 | Tolliver | 264/177 F |
| 3,914,488 | 10/1975 | Gorrafa | 264/177 F |

FOREIGN PATENTS OR APPLICATIONS

| | | | |
|---|---|---|---|
| 1,449,751 | 8/1966 | France | 264/177 F |
| 40-9535 | 5/1965 | Japan | 264/177 F |
| 44-899 | 1/1969 | Japan | 264/177 F |
| 47-23972 | 7/1972 | Japan | 264/177 F |

OTHER PUBLICATIONS

"Polymer Processing" by J. McKelvey, pp. 72–74, John Wiley Inc., N. Y. 1962.

*Primary Examiner*—Jay H. Woo

*Attorney, Agent, or Firm*—Malcolm G. Dunn; Daniel B. Reece, III

[57] ABSTRACT

Method for melt spinning from inelastic materials extruded lengths of predetermined cross-sections from predetermined arrangements in spinnerets of non-round orifices having one axis or no axis of symmetry in the plane of the spinneret face, and to such arrangements of two or more such spinning orifices in spinnerets for practice of the method by which non-axisymmetric emergence behavior, i.e., "kneeing," of inelastic fluid streams from spinnerets is utilized. Each non-round orifice in the arrangement has a significant kneeing potential of greater than (±) 0.1, and preferably greater than (±) 0.25 and is so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2\, dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are non-coincident at each orifice exit so that the flow of the extruding material from the orifice has non-axisymmetric emergence behavior, where $(V^2)_{centroid}$ is the centroid of the square of the velocity profile;

$(V)_{centroid}$ is the centroid of the velocity profile;

$\int_A$ is the integral over the orifice cross-section area;

$V^2$ is the square of the velocity at any radius vector location $\vec{r}$;

$\vec{r}$ is the radius vector from the origin of any set of orthogonal coordinate axes to any point r within the orifice cross-section; and $dA$ is the differential area element.

The extruding material from such arranged spinning orifices coalesces to form a single extruded length of predetermined cross-section.

10 Claims, 14 Drawing Figures

THE EFFECT OF CHANGING THE VARIABLE NORMALIZED "b" DIMENSION ON KNEEING FROM A "T" SHAPED CROSS-SECTION ORIFICE HAVING ONE AXIS OF SYMMETRY

THE EFFECT OF CHANGING THE VARIABLE NORMALIZED "b" DIMENSION ON KNEEING FROM A "T" SHAPED CROSS-SECTION ORIFICE HAVING ONE AXIS OF SYMMETRY

SELECTED T'S WHERE THE NORMALIZED "d" DIMENSION IN THE "T" SHAPED CROSS-SECTION ORIFICE HAVING ONE AXIS OF SYMMETRY IS VARIED

ARRANGEMENTS IN SPINNERETS OF SPINNING ORIFICES HAVING SIGNIFICANT KNEEING POTENTIAL

BACKGROUND OF THE INVENTION

This invention is directed to a method for melt spinning from inelastic materials extruded lengths of predetermined cross-sections from predetermined arrangements in spinnerets of non-round orifices of one or no axis of symmetry in the plane of the spinneret face, and to such orifice arrangements in spinnerets for practice of the method by which non-axisymmetric emergence behavior, i.e. "kneeing", of inelastic fluid streams from spinnerets is utilized.

The elimination of nonaxisymmetric emergence behavior of fluid streams i.e., "kneeing" in melt spinning filaments is desirable in a number of instances, and the patents to Paliyenko et, U.S. Pat. Nos. 3,640,670 and 3,734,993; and to Shemdin, U.S. Pat. No. 3,738,789 are concerned with solutions for minimizing or eliminating kneeing of filaments upon extrusion of the filaments from spinnerets.

In a co-filed, co-pending patent application the invention concerns a solution for kneeing of filaments from spinning orifices of non-round cross-section, the orifices having either one or no axis of symmetry in the plane of the spinneret face. The spinning holes or orifices are so formed as to eliminate non-axisymmetric emergence behavior in the spinning of inelastic materials, i.e. to eliminate "kneeing" of filaments as they are extruded from the spinning orifices. In the co-pending invention, each orifice is so dimensioned that the coordinates of the centroid of the square of the velocity profile of the extruding material in the plane perpendicular to the axis of the orifice and the coordinates of the centroid of the velocity profile of the extruding material in the plane perpendicular to the axis of the orifice are essentially coincident at the orifice exit. Such orifice cross-sections are thus essentially non-kneeing. The expression, "essentially non-kneeing" will be explained in more detail herein.

As explained in the co-pending application, a filament "knees" when the line of flow of the extruded filament from the orifice is bent out of the vertical back toward the spinneret face at an angle relative to the perpendicular to the spinneret face. In some instances the filament is bent to such extent that the filament forming material bends back and touches the spinneret face. This leaves a drip or blob of material on the spinneret face which can sometimes block a spinning orifice and interfere with filament formation. Sometimes such "kneeing" undesirably results in the coalescence of two or more adjacent filaments.

An example of a non-round cross-sectioned spinning orifice having one axis of symmetry in the plane of the spinneret face would be a T-shaped cross-section with the leg of the T being perpendicular to the bar of the T and intersecting the bar at its midpoint. A bisector extending through the bar and leg would form two symmetrical halves with the "bisector" constituting the "axis" of the one axis of symmetry. In this example, there are no other possible axes of symmetry in the plane of the spinneret face.

An example of a non-round cross-sectioned orifice having no axis of symmetry in the plane of the spinneret face would be a polygonal configuration having more than four sides, each side of the polygon intersecting at right angles with an adjacent side.

It should be understood that in each of the above examples the spinning orifice has the same shape or configuration throughout its capillary length, and is dimensionally constant or the same throughout the length of the capillary.

Textile yarn filaments having non-round cross-sections have been found to be desirable because different physical and aesthetic properties can be obtained by design, more so than with filaments having round cross-sections.

One example of a non-round cross-section would be an H shaped filament, which can be made from an H shaped spinning orifice. The formation of an H shaped spinning orifice in a spinneret, however, is complex and thus the manufacture of such spinnerets is difficult and costly.

There are various other non-round cross-sections, of course, one of them most frequently in use being a T shaped cross-section. For instance the two Paliyenko et al. patents, U.S. Pat. Nos. 3,640,670 and 3,734,993, mentioned above disclose what is called a "split T" orifice, which is constructed by forming two rectangular orifices spaced from but in close proximity to each other to form a T configuration. One of the rectangular orifices, the "stem", depends perpendicularly from the midpoint of the other rectangular orifice, the "cross-bar". The stem is spaced from the cross to form a gap therebetween of about 0.0001 inch to about 0.008 inch, or preferably about 0.002 inch. Filament forming streams extruding from the split T orifice are said by the patentees "to coalesce in a zone about 1/64 to ½ inch from the face of the spinneret plate to form a relatively well defined T-shaped filament". The extrusion from the split T, according to the patentees, occurs "without kneeing". The resulting coalescense is due to the "Barus effect", meaning that the spacing of the two rectangles making up the split T is such as to enable the extruded materials to expand at the exit and thus come into contact with each other. The more elastic the material being extruded, the easier it is to utilize the Barus effect to cause coalescence because of the greater expansion of the material at the exit of the orifice. The construction, however, of a split T is expensive and requires close manufacturing control as the two rectangular orifices making up the T must be spaced very closely but yet not so close as to break through the bridging constituting the space between the two orifices. There is no kneeing from rectangular orifices, each of which has more than one axis of symmetry in the plane of the spinneret face.

There are, however, some instances where nonaxisymmetric emergence behavior of fluid streams, i.e. "kneeing" of the filaments upon emerging from the spinning orifices, are desirable. The instant invention is directed to particular applications of these instances.

SUMMARY OF THE INVENTION

The invention concerns a method for melt spinning from inelastic materials filaments or indefinite extruded lengths of predetermined cross-sections from at least one predetermined arrangement in a spinneret of two or more non-round spinning orifices similarly having either one axis or no axis of symmetry in the plane of the spinneret face and also having a significant kneeing potential so that as an inelastic material is extruded from each orifice of the arrangement, it knees toward and coalesces with the material being extruded from the other orifice(s) of the same arrangement to form a single extruded indefinite length of predetermined cross-section.

The invention also concerns predetermined arrangements in spinnerets of two or more holes or orifices with respect to each other, each orifice of the arrangement similarly being of non-round cross-section and having either one or no axis of symmetry in the plane of the spinneret face and having a significant kneeing potential, so that as an inelastic material is extruded from each orifice of the arrangement, it knees toward and coalesces with the material being extruded from the other orifice(s) of the same arrangement to form a single extruded length of predetermined cross-section. The spacing between orifice cross-sections in an arrangement may be greater than that in which the "Barus effect" would be effective.

The "extruded length" may be a single filament or a single article, as will herein be further described.

In the invention each spinning orifice of non-round cross-section is so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2\, dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are non-coincident at each orifice exit so that the flow of the extruding material from the orifice has nonaxisymmetric emergence behavior, where $(V^2)_{centroid}$ is the centroid of the square of the velocity profile;

$(V)_{centroid}$ is the centroid of the velocity profile;

$\int_A$ is the integral over the orifice cross-sectional area;

$V^2$ is the square of the velocity at any radius vector location $\vec{r}$;

$\vec{r}$ is the radius vector from the origin of any set of orthogonal coordinate axes to any point r within the orifice cross-section; and $dA$ is the differential area element. Each two or more of the above-described spinning orifices is arranged with respect to each other that the extruding material coalesces to form filaments and or articles of predetermined cross-sections.

As stated previously in connection with the co-filed, co-pending application, it should be understood that each orifice has the same shape or configuration throughout its capillary length, and is dimensionally constant or the same throughout the length of the capillary.

The velocity profile may be measured by a commercially available laser velocimeter instrument. The instrument is focused at any point in the spinning orifice cross-section at its exit or in the plane of the spinneret face to measure the velocity of the material being extruded. A series of measurements are made at predetermined points in the orifice cross-section to develop the velocity profile. The coordinates of the centroid of the square of the velocity profile and of the centroid of the velocity profile are then calculated in accordance with the equation given above. A trial and error procedure is then used to isolate the desired kneeing potential by changing the dimensions of the orifice cross-section.

The invention applies to steady state laminar flows of essentially inelastic materials through spinnerets. "Steady state" means no change with respect to time in velocity or property. "Laminar flow" means parallel or streamline with essentially no intermixture of layers (if layers could be seen), as distinguished from turbulence with resultant intermixing of the "layers". The Reynolds number based on an equivalent diameter of the cross-section of the orifice is below 1000, with most cases of interest being below 10.

By "equivalent diameter" is meant four times the cross-sectional area divided by the wetted perimeter of the cross-section. For instance, if the orifice is a T-shaped cross-section, the perimeter distance around the outline of the T is added to find the "wetted perimeter".

By "essentially inelastic materials" is meant spinning materials such as in polyesters, as for instance, polyethylene terephthalate having I.V.'s (inherent viscosities) in the commercial range of 0.35 to 1.2; poly 1,4-cyclohexanedimethylene terephthalate having an I.V. in the range of 0.5 to 1.3; and polytetramethylene terephthalate having an I.V. in the range 0.5 to 1.7. Glass would also be another example of an inelastic material as well as nylons such as polyhexamethylene adipamide and polycaprolactam with I.V.s of textile interest. In contrast, therefore, some examples of "elastic" spinning materials which are thought possibly not applicable in the practice of this invention would be polyolefins, polypropylenes, cellulose acetate solutions dissolved in acetone, and polyacrylonitrile vinylidene chloride solutions dissolved in acetone.

"Kneeing Potential" as mentioned herein is defined as the absolute value of the normalized distance between the centroid of the square of the velocity profile ($Vc^2$) and the centroid of the velocity profile ($Vc$), or ($Vc^2$–$Vc$). This is essentially the length of the arm of the moment which is causing the kneeing, and thus for constant throughput in the capillary of the orifice in the spinneret, it is a measure of the severity of the kneeing. It is well recognized that as the throughput per orifice for a fixed orifice size is decreased, the severity of kneeing will decrease since the kneeing moment is proportional to the absolute value of ($Vc^2$–$Vc$) times the square of the average velocity ($Vavg^2$). However, for essentially all practical cases when the absolute value of ($Vc^2$–$Vc$) is equal to or less than 0.03 and for normal average velocity ranging from three (3) to thirty (30 ) feet per minute, kneeing poses no problem. By "absolute value" is meant that on a number line, it is the distance from zero point, regardless of direction or sign. Thus, the absolute value of 7 is 7, of −7 is 7, of −4 is 4. "Absolute value" is usually indicated by bracketing a numeral with vertical lines. Thus, the statement "The absolute value of −9 is 9" is written $|-9|=9$. Thus also, in this disclosure the absolute value of "kneeing potential" will from time to time be indicated in the following form: $|Vc^2-Vc|$, followed in turn by an equal sign (=) and a numeral or numerals, but without any indication of the numeral(s) being plus or minus.

In general, the kneeing direction will be in the direction of a line extending from the centroid of the square of the velocity profile ($Vc^2$) to the centroid of the velocity profile ($Vc$), as will be herein explained by illustration.

DRAWINGS

In the drawings:

FIG. 1 is a plan view of a spinneret, shown only in part, illustrating a non-round spinning orifice of T-shaped cross-section having one axis of symmetry in the plane of the spinneret face, and further illustrating the orifice cross-section in relation to an X,Y coordinate system as a frame of reference for the location of the centroids, $Vc^2$ and $Vc$, for illustrating the kneeing direction, which is in the direction of the line extending from the point representing the centroid, $Vc^2$, to the point representing the centroid, $Vc$;

FIG. 2 is a plan view of a spinneret, shown only in part, illustrating a non-round spinning orifice having no axis of symmetry in the plane of the spinneret face, and also illustrating the orifice cross-section in relation to an X,Y coordinate system as a frame of reference for the location of the centroids, $Vc^2$ and $Vc$, for further illustrating the kneeing direction, which is in the direction of the line extending from the point representing the centroid, $Vc^2$, to the point representing the centroid, $Vc$;

Figure 8:
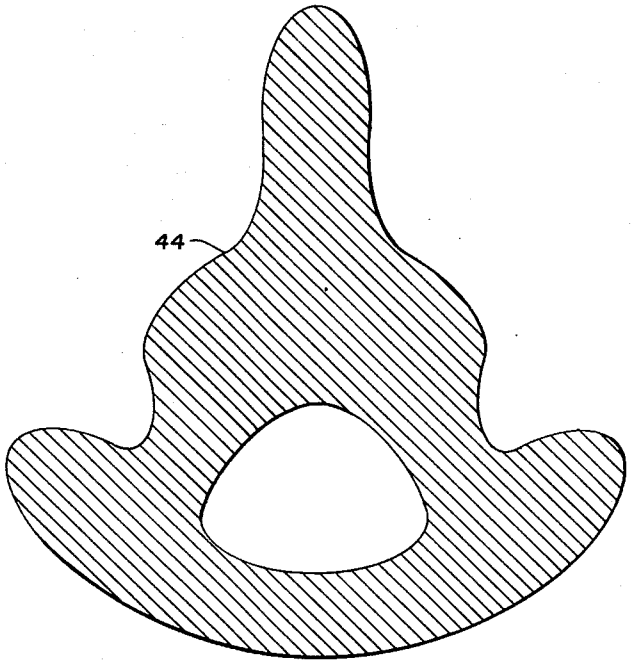
Figure 7:
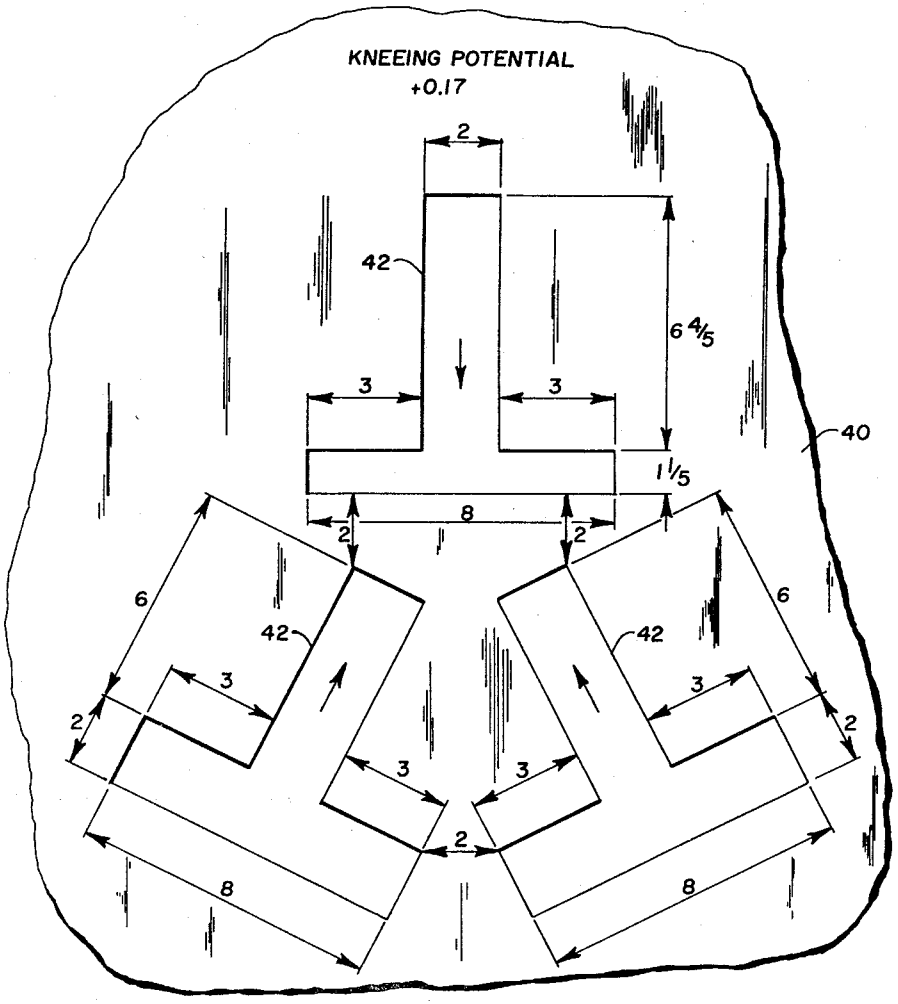
Figure 10:
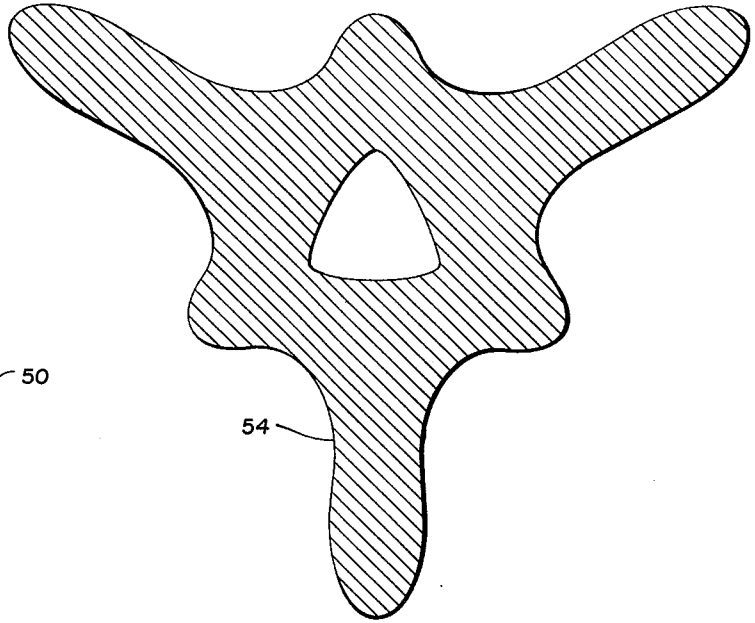
Figure 9:
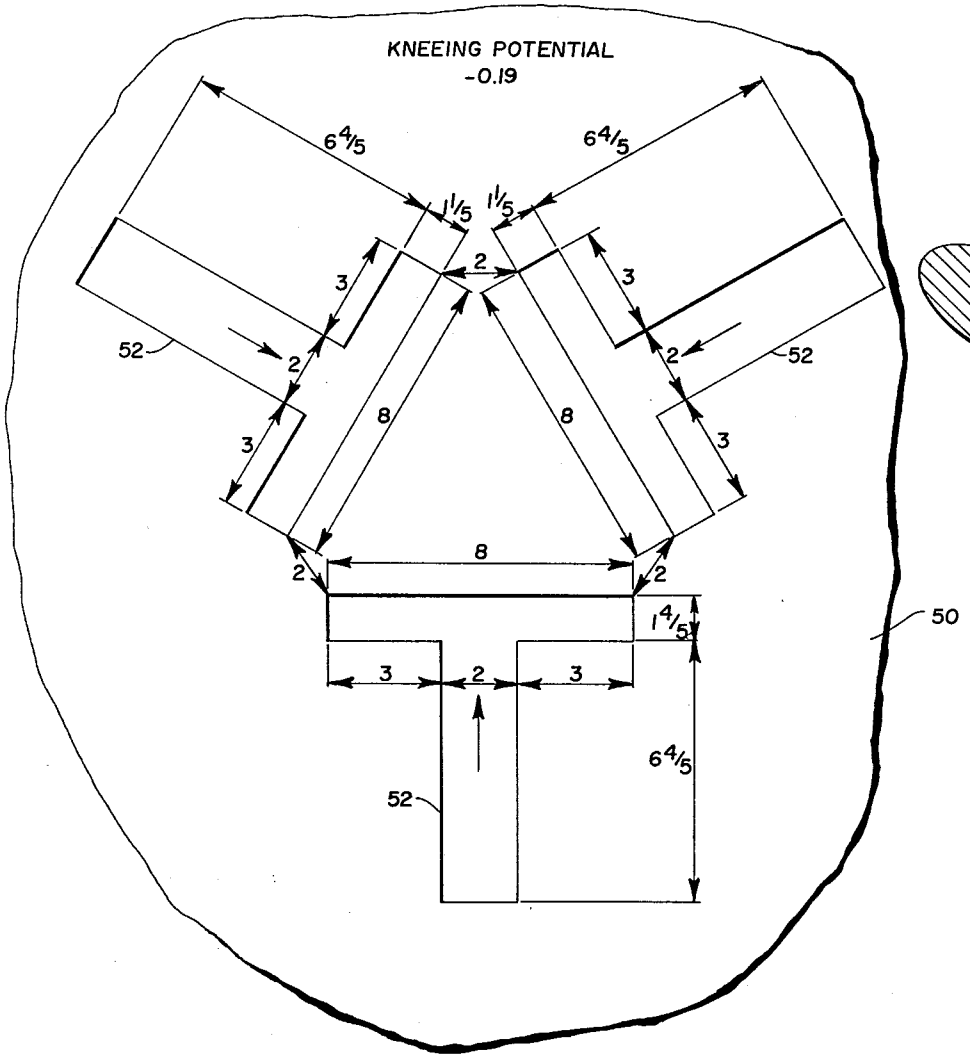
Figure 11:
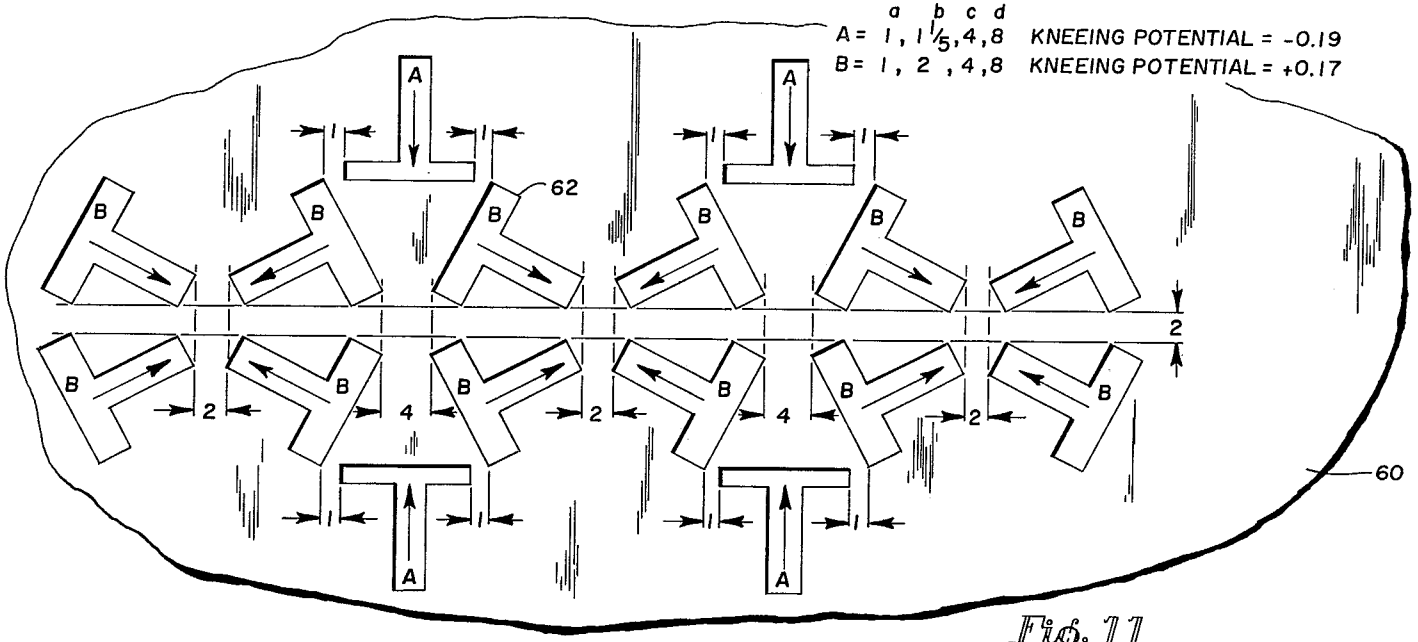
Figure 12:
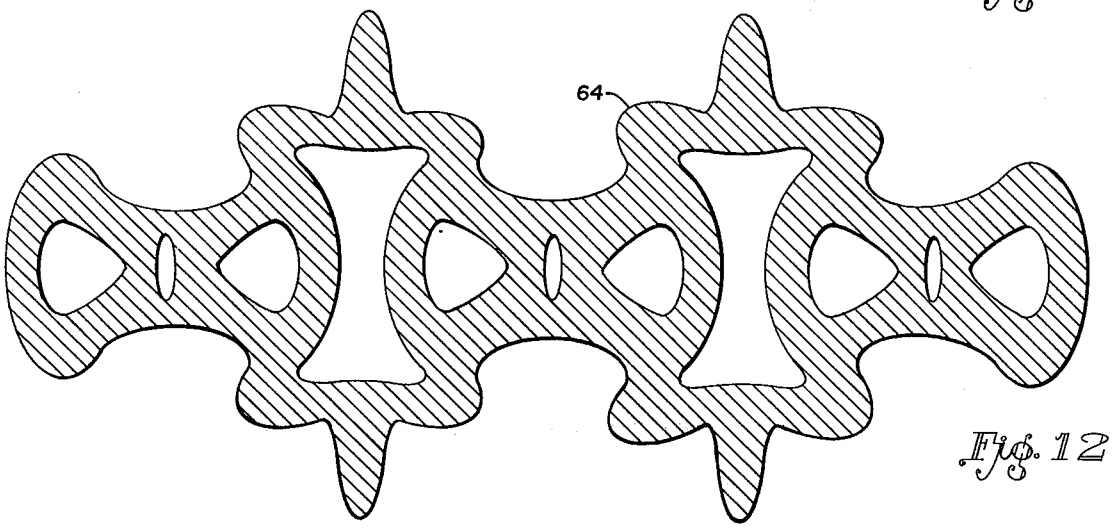
Figure 14:
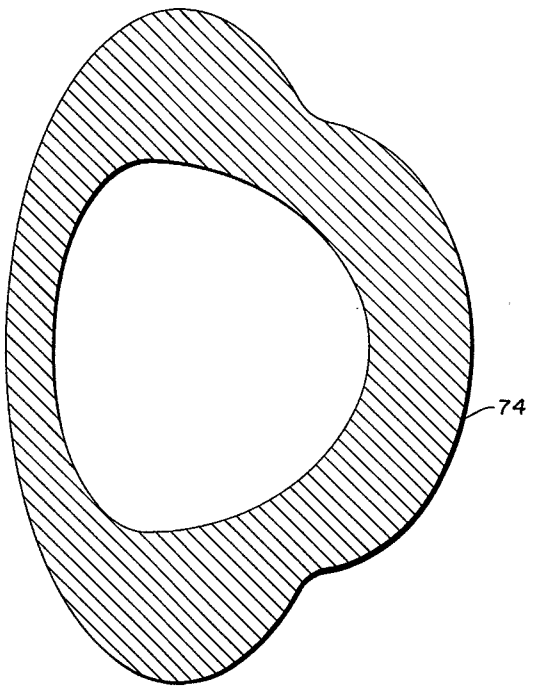
Figure 13:
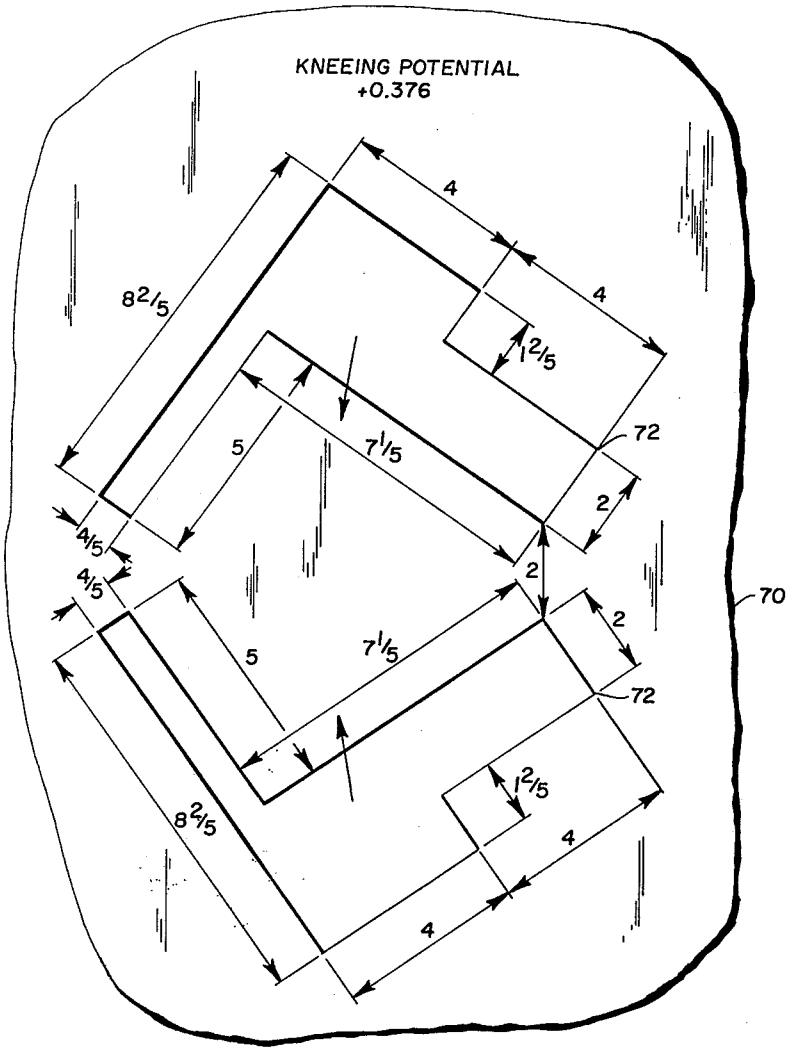

FIG. 7 is a plan view of another arrangement with respect to each other of three non-round spinning orifices of T-shaped cross-section, each orifice having one axis of symmetry in the plane of a spinneret face and having significant kneeing potential in the direction of the leg for each of two of the T's and in the direction of the bar of the third T toward the legs of the first two T's, the spinneret being shown only in part;

FIG. 8 is a view of approximately the filament cross-section obtained from extrusion through the non-round orifice arrangement of FIG. 7;

FIG. 9 is a plan view of still another arrangement with respect to each other of three non-round spinning orifices of T-shaped cross-section, each orifice having one axis of symmetry in the plane of a spinneret face and having significant kneeing potential in the direction of the bar for each of the three T's, as shown by the arrows, the spinneret being shown only in part;

FIG. 10 is a view of approximately the filament cross-section obtained from extrusion through the non-round orifice arrangement of FIG. 9;

FIG. 11 is a plan view of a further arrangement with respect to each other of a multiple number of non-round spinning orifices of T-shaped cross-section, each orifice having one axis of symmetry in the plane of a spinneret face, the direction of kneeing from each orifice being shown by the arrows, the spinneret being shown only in part;

FIG. 12 is a view of approximately the article cross-section obtained from extrusion through the non-round orifice arrangement of FIG. 11;

FIG. 13 is a plan view of a still further arrangement with respect to each other of two non-round spinning orifices of polygonal cross-section, each orifice having no axis of symmetry in the plane of a spinneret face and having significant kneeing potential in the direction shown by the arrow, the spinneret being shown only in part; and FIG. 14 is a view of approximately the filament cross-section obtained from extrusion through the non-round orifice arrangement of FIG. 13.

DESCRIPTION OF THE PREFERRED EMBODIMENT

Figure 1:
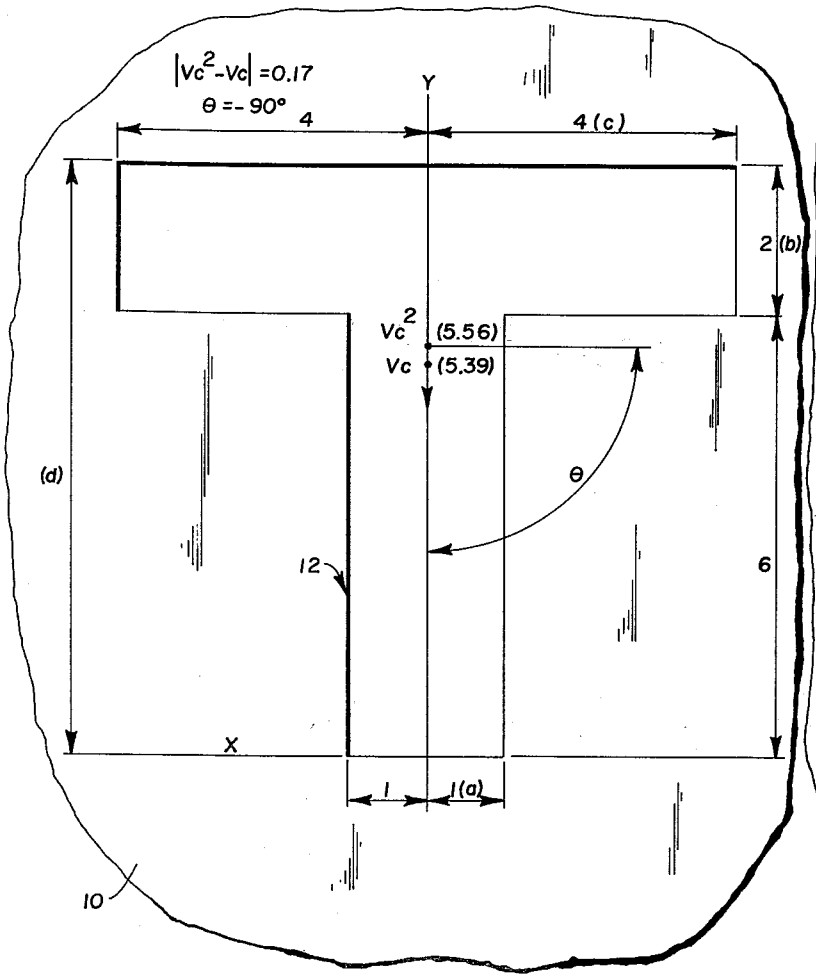

In reference to the drawings, FIG. 1 illustrates a portion of a spinneret 10 having a spinning orifice 12 that is representative of a non-round orifice having one axis of symmetry in the plane of the spinneret face. The configuration of the non-round orifice is T-shaped, and the bisector of the T-shaped orifice, which also constitutes the axis line of the orifice coincides with the Y-coordinate of the X-Y coordinate system shown. Thus, the portion of the T-shaped orifice on one side of the Y-coordinate is symmetrical to the portion of the T-shaped orifice on the other side of the Y-coordinate.

The T-shaped non-round cross-section has the following dimensions:

the width of the leg = $2a$,
the width of the bar = $b$,
the length of the bar = $2c$, and
the length of the leg = $d-b$.

Figure 2:
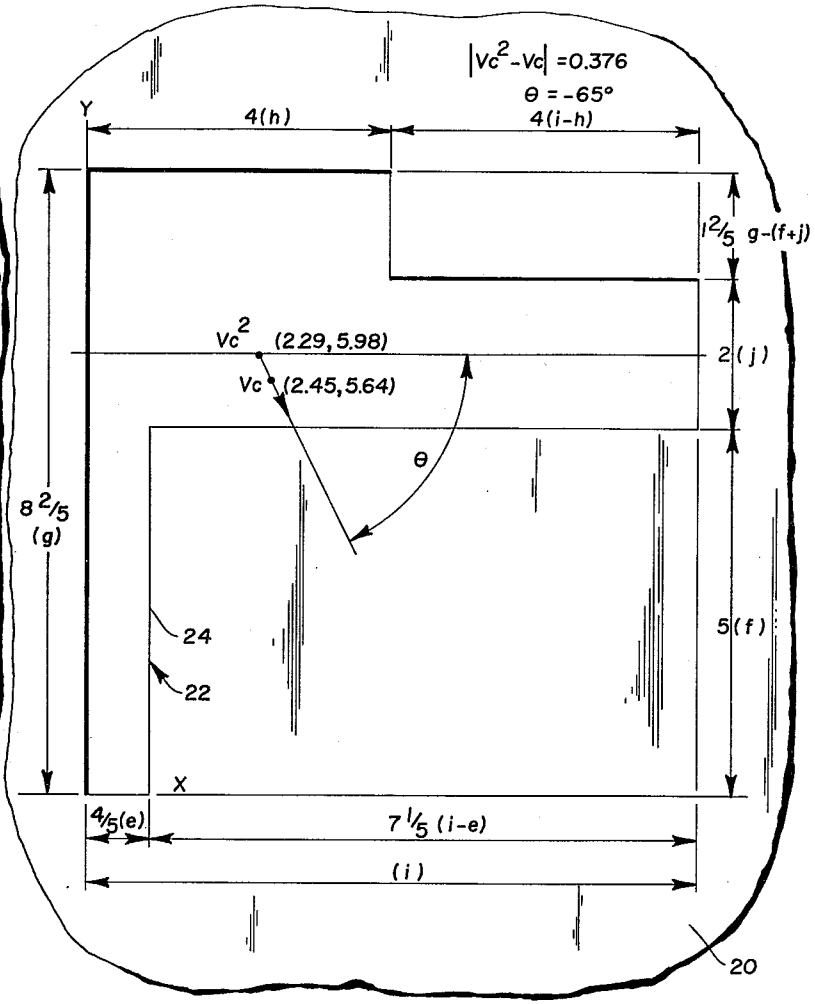

In contrast to FIG. 1, FIG. 2 illustrates a portion of a spinneret 20 having a spinning orifice 22 that is representative of a non-round orifice having no axis of symmetry in the plane of the spinneret face. The configuration of the non-round orifice cross-section can be characterized as being a polygon having more than four sides or a plurality of sides 24, each side intersecting at right angles with an adjacent side. The polygonal configuration of the orifice 22 has the following dimensions, respectively, for the sides of the polygon: $e$, $g$, $h$, $g-(f+j)$, $i-h$, $j$, $i-e$ and $f$.

It should be recognized that there are other non-round spinning orifices that may be used in the practice of this invention, but for purposes of illustration the orifice configurations that will be used in the different predetermined arrangements of orifices hereinafter to be discussed will either be similar to that shown in FIG. 1 or to that shown in FIG. 2.

The particular dimensioned non-round spinning orifices shown in FIGS. 1 and 2 are examples of severely kneeing orifice cross-sections. The non-round spinning orifices that will be shown in the different predetermined arrangement of orifices of this invention will be so dimensioned in accordance with the concept of this invention that each orifice of an arrangement will have significant kneeing potential (K.P.), i.e., the kneeing will be such as to cause coalescence of adjacent extrusions from a predetermined arrangement of spinning orifices. Such kneeing, however, would not be to such extent as to touch the spinneret face because each extrusion in the orifice arrangement knees toward another extrusion in the same orifice arrangement.

Figure 3:
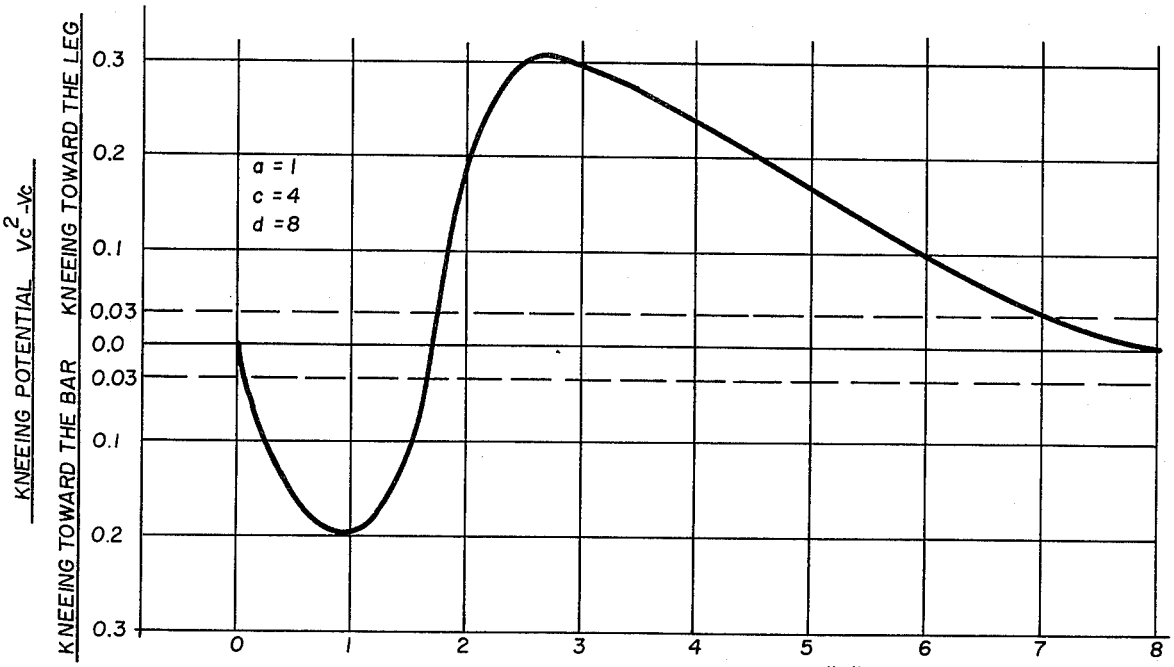
FIG. 3 illustrates a graph wherein the $b$ normalized dimension of the T-shaped cross-sectioned spinning orifice shown in FIG. 1 is varied.

By "essentially non-kneeing", as was mentioned above, it is meant that a certain latitude may be allowed in which acceptable levels of kneeing may occur. Such "essentially non-kneeing" is considered commercially practical because there is no interference with an adjacent filament or filaments to form a coalescence. In other words, the kneeing is only to a slight extent and would normally not cause any production problem. This latitude has been found experimentally to be represented by about (±) 0.03 units in the normalized $Vc^2$—$Vc$ representation of kneeing potential. This is illustrated by the graph shown in FIG. 3 in which the normalized *b* dimension, for example, is varied in the T-shaped cross-sectioned orifice of FIG. 1 and the normalized dimensions *a*, *c* and *d* are fixed respectively at 1, 4 and 8. In FIG. 3 it will be noted that at the points of the cross-over of the curve with the ($Vc^2$—$Vc$) axis there is no kneeing.

By "normalized dimension" it is meant that this is a proportional relationship within the particular cross-section of the spinning orifice and not in actual units of measurement. The "kneeing potential" shown in the graph of FIG. 3 is defined as the normalized linear distance between the centroid of the square of the velocity profile ($Vc^2$) and the centroid of the velocity profile ($Vc$). As mentioned above, this is simply a moment arm definition. It will be noticed, also, from the graph is FIG. 3 that when *b* is equal to zero, no kneeing occurs, since the configuration of the resulting orifice cross-section is simply a rectangle. However, as *b* increases from zero, kneeing starts occurring toward the bar of the T, reaches a maximum, then passes back through zero. It then starts kneeing toward the leg of the T, reaches another maximum, and returns to zero at b = 8.

Figure 4:
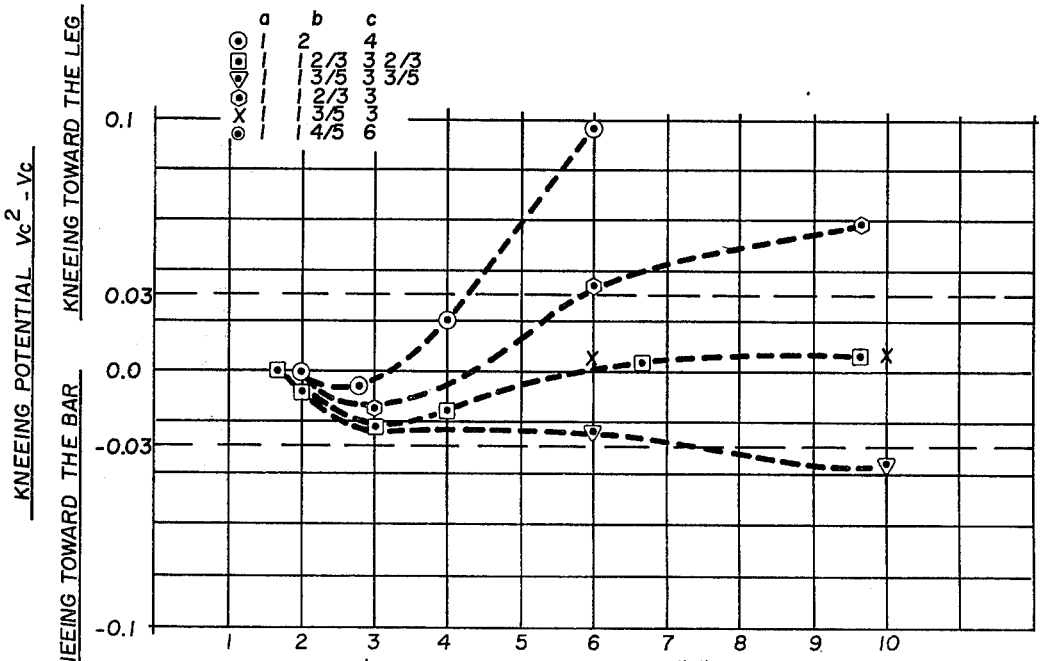
FIG. 4 illustrates a graph wherein the $d$ normalized dimension of the T-shaped cross-sectioned orifice shown in FIG. 1 is varied.

In FIG. 4, the illustrated graph shows the normalized *d* dimension of the T-shaped cross-sectioned orifice of FIG. 1 being varied, while the normalized *a*, *b* and *c* dimensions are as indicated in FIG. 4.

As previously mentioned, the kneeing direction will be in the direction of a line extending from the centroid of the square of the velocity profile ($Vc^2$) to the centroid of the velocity profile ($Vc$). In FIG. 1, both points $Vc^2$ and $Vc$ are shown as being on the Y-coordinate line, and the direction of kneeing is shown by the arrow as being toward the leg of the T. In a one axis of symmetry situation for this T-shaped cross-sectioned orifice, kneeing is only possible in the plus or minus direction along the Y-coordinate, which is also the axis line. Both centroids, $Vc^2$ and $Vc$, are located only along the Y-coordinate (or Y-axis), and their particular location is shown by the coordinate figures, which are normalized dimensions, in parenthesis beside the centroid points. The absolute value of $Vc^2$—$Vc$, as shown in the FIG. 1, is 0.17. This is the kneeing potential. As mentioned above, the kneeing is toward the leg of the T, and the angle $\theta$ (theta) is −90°. The angle, theta, may be measured either clockwise (negative) or counterclockwise (positive) direction from the line shown passing through the centroid of the square of the velocity profile ($Vc^2$), which line is parallel to the X-coordinate axis.

On the other hand in FIG. 2, in the non-round orifice cross-section, which has no axis of symmetry in the plane of the spinneret face, the kneeing direction may have both X and Y components, as shown by the coordinate figures, which are normalized dimensions, in parenthesis to one side of the centroid points, $Vc^2$ and $Vc$. In FIG. 2, the absolute value of $Vc^2$—$Vc$ equals 0.376, and the angle of theta equals −65°. The direction of kneeing is shown by the arrow extending from $Vc^2$ to $Vc$.

In reference to the graph shown in FIG. 3, the significant kneeing potential of this invention, $Vc^2$—$Vc$, of the orifices of the type represented by FIG. 1, will preferably be greater than (±) 0.1, and still more preferred of greater than (±) 0.25. The same kneeing potential, however, is also applicable to an orifice of the type represented by FIG. 2, although no graph has been shown representative of the cross-section represented by FIG. 2. So long as the kneeing in the arrangement of orifices to be discussed herein is toward another filament in the arrangement, such kneeing will not result in the filament touching the face of the spinneret.

Figure 5:
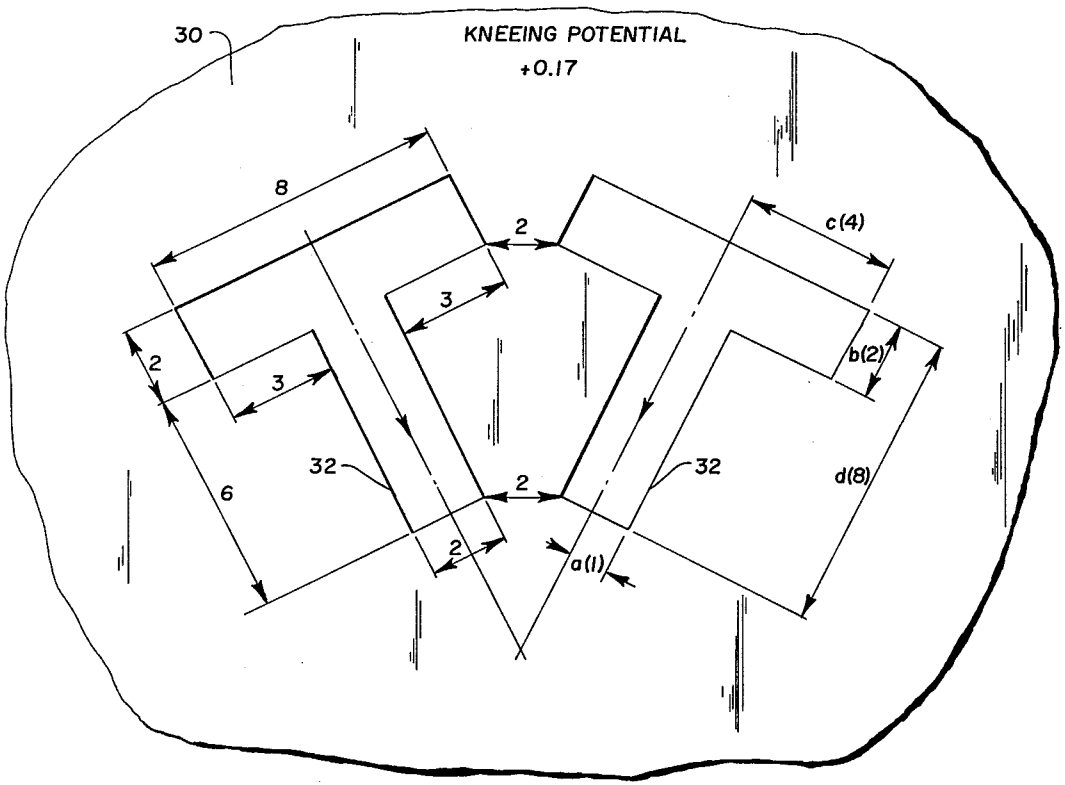
FIG. 5 is a plan view of an arrangement with respect to each other of two non-round spinning orifices of T-shaped cross-section, each orifice having one axis of symmetry in the plane of a spinneret face and having significant kneeing potential in the direction of the leg of the T, as shown by the arrows, the spinneret being shown only in part.

In reference now to the first of the disclosed arrangements of kneeing spinning orifices, FIG. 5 discloses an arrangement in a partially shown spinneret 30 of two such orifices 32 of T-shaped construction, each orifice cross-section having one axis of symmetry in the plane of the spinneret face. This arrangement can be called a "dual T-leg knee-ers arrangement" since there are two T's with each T kneeing in the direction toward its leg. The normalized dimensions are as indicated in FIG. 5, with the spacing between the two orifices at the closest points of their approach to each other being shown as two (2) such units of normalized dimension at one corner of each leg of the T and at one corner of each bar of the T. The absolute value of the kneeing potential is shown as being equal to 0.17, with the kneeing direction being in the direction of the legs of the two T's, as shown by the arrows.

Figure 6:
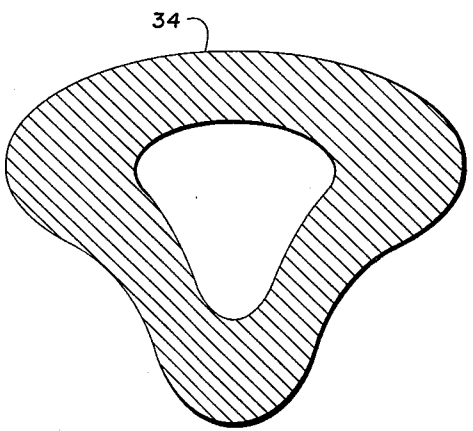
FIG. 6 is a view of approximately the filament cross-section obtained from extrusion through the non-round orifice arrangement of FIG. 5.

FIG. 6 discloses the approximate cross-section of the resulting two coalesced filaments forming a single extruded length 34 of predetermined cross-section from the orifice arrangement disclosed in FIG. 5. In this instance the resulting "single extruded length" is a hollow filament having a trilateral appearance.

FIG. 7 is an arrangement in a partially shown spinneret 40 of three spinning orifices 42 of T-shaped cross-section, each having one axis of symmetry in the plane of the spinneret face, with two of the T's kneeing toward the leg of the T's and also toward the third T, while the third T is shown as kneeing toward the bar of the T and also toward the other two T's. This arrangement can be called a "dual T-leg knee-ers-single T bar knee-er arrangement" because of the particular manner of kneeing. The kneeing potential of the first two T's is shown as being +0.17, while the kneeing potential for the third T is shown as being −0.19. The closest point of approach between the T's is shown as being two (2) units of normalized dimension.

FIG. 8 represents the approximate resulting cross-section of the single extruded length 44 of predetermined cross-section from the orifice arrangement shown in FIG. 7. The "single extruded length" is another form of hollow filament.

FIG. 9 is another arrangement in a partially shown spinneret 50 of three spinning orifices 52 of T-shaped cross-section, each having one axis of symmetry in the plane of the spinneret face, with each T kneeing toward the bar of the T and also toward the other two T's. This arrangement can be called a "tri-T-bar knee-ers arrangement". The kneeing potential of each of the T's is shown as being −0.19. The closest point of approach between the T's is shown as being two (2) units of normalized dimension.

FIG. 10 represents the approximate resulting cross-section of the single extruded length 54 of predetermined cross-section from the spinning orifice arrangement shown in FIG. 9. The "single extruded length" is still another form of hollow filament.

FIG. 11 is an arrangement in a spinneret 60, shown only in part, of multiple spinning orifices 62 of T-shaped cross-section, each orifice having one axis of symmetry in the plane of the spinneret face. The arrows shown in the drawing indicate the respective direction of kneeing for each of the T's. This arrangement can be called a "multiple-T-multiple leg and bar knee-ers arrangement". The T's identified by the letter A in the drawing have the normalized dimensions as shown in one corner of the drawing, with a kneeing potential of −0.19. The remaining T's have the normalized dimensions as also shown in one corner of the drawing, with a kneeing potential of +0.17. The A T's have their point of closest approach to adjacent T's at one (1) unit of normalized dimension because the adjacent T's are shown as kneeing in directions away from the A T's. The closest approach for most of the remaining T's from each other is shown as being two (2) units of normalized dimension, except for those few shown as being four (4) units of normalized dimension.

Obviously, the multiple orifice arrangement shown in FIG. 11 may be altered in order to obtain the desired predetermined cross-sectioned extruded length.

FIG. 12 represents the approximate resulting cross-section of the single extruded length 64 from the multiple spinning orifice arrangement of FIG. 11. The "single extruded length" may be characterized as a "tape" or "article" having a plurality of hollow spaces extending along the length of the tape or article. Such "extruded lengths" may be used as insulating tape, for instance, or form bands for use in woven fabrics and the like.

FIG. 13 is an arrangement in a partially shown spinneret 70 of two spinning orifices 72, each orifice being of polygonal configuration and having no axis of symmetry in the plane of the spinneret face. This arrangement can be called a "dual polygon-knee-ers arrangement". The direction of kneeing is shown by the arrows, and the absolute value of the kneeing potential for each orifice cross-section is shown as being 0.376.

FIG. 14 represents the approximate resulting cross-section of the single extruded length 74 of predetermined cross-section from the orifice arrangement shown in FIG. 13. The "single extruded length" is another form of hollow filament.

Other arrangements of spinning orifices having one axis or no axis of symmetry may be used, other than the ones illustrated by the drawings, so long as the coordinates of the centroid of the square of the velocity profile and of the centroid of the velocity profile are non-coincident in the manner disclosed herein.

The invention has been described in detail with particular reference to certain preferred embodiments thereof, but it will be understood that variations and modifications may be made within the spirit and scope of the invention.

I claim:

1. A method for melt spinning, from inelastic materials, extruded lengths of predetermined cross-sections by arranging and spacing two or more spinning orifices with respect to each other so that the extruding material from each such arranged spinning orifices coalesces to form a single extruded length of predetermined cross-section, wherein the spinning orifices of each arrangement are each of non-round cross-section and has either one axis or no axis of symmetry in the plane of the spinneret and is so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2\, dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are non-coincident at each orifice exit so that the flow of the extruding material from the orifice has non-axisymmetric emergence behavior, where $(V^2)_{centroid}$ is the centroid of the square of the velocity profile;

$(V)_{centroid}$ is the centroid of the velocity profile;

$\int_A$ is the integral over the orifice cross-section area;

$V^2$ is the square of the velocity at any radius vector location $\vec{r}$;

$\vec{r}$ is the radius vector from the origin of any set of orthogonal coordinate axes to any point $r$ within the orifice cross-section; and $dA$ is the differential area element.

2. The method as defined in claim 1, and wherein each spinning orifice of the arrangement is formed in the configuration of a T-shaped cross-section having one axis of symmetry in the plane of the spinneret face and having an absolute value of kneeing potential greater than 0.1.

3. The method as defined in claim 2, and wherein the T-shaped spinning orifices are arranged substantially in the manner disclosed in FIG. 5.

4. The method as defined in claim 2, and wherein the T-shaped spinning orifices are arranged substantially in the manner disclosed in FIG. 7.

5. The method as defined in claim 2, and wherein the T-shaped spinning orifices are arranged substantially in the manner disclosed in FIG. 9.

6. The method as defined in claim 2, and wherein the T-shaped spinning orifices are arranged substantially in the manner disclosed in FIG. 11.

7. The method as defined in claim 2, and wherein each spinning orifice of the arrangement has an absolute value of kneeing potential greater than 0.25.

8. The method as defined in claim 1, and wherein each spinning orifice of the arrangement is formed in the configuration of a polygon having no axis of symmetry in the plane of the spinneret face and having more than four sides, each side of the polygon intersecting at right angles with an adjacent side, the polygonal cross-sectioned spinning orifice having an absolute value of kneeing potential greater than 0.1.

9. The method as defined in claim 8, and wherein each polygonal spinning orifice of the arrangement has an absolute value of kneeing potential greater than 0.25.

10. The method as defined in claim 8, and wherein the polygonal spinning orifices are arranged substantially in the manner disclosed in FIG. 13.

* * * * *